US009857123B2

(12) United States Patent
McLaughlin

(10) Patent No.: US 9,857,123 B2
(45) Date of Patent: Jan. 2, 2018

(54) SYSTEM AND METHOD FOR DEFROSTING A CONDENSOR WITHOUT EXTERNAL HEATING

(71) Applicant: John D. McLaughlin, Troy, NY (US)

(72) Inventor: John D. McLaughlin, Troy, NY (US)

( * ) Notice: Subject to any disclaimer, the term of this patent is extended or adjusted under 35 U.S.C. 154(b) by 0 days.

(21) Appl. No.: 15/134,773

(22) Filed: Apr. 21, 2016

(65) Prior Publication Data

US 2017/0038124 A1 Feb. 9, 2017

Related U.S. Application Data

(60) Provisional application No. 62/201,909, filed on Aug. 6, 2015.

(51) Int. Cl.

| | |
|---|---|
| ***F25D 21/12*** | (2006.01) |
| ***F25D 21/14*** | (2006.01) |
| ***F24F 6/02*** | (2006.01) |
| *F24F 11/00* | (2006.01) |
| *F25B 47/00* | (2006.01) |
| *F25B 47/02* | (2006.01) |
| *F25B 31/00* | (2006.01) |
| *F25D 21/06* | (2006.01) |
| *F24F 13/22* | (2006.01) |

(52) U.S. Cl.

CPC ..... *F25D 21/125* (2013.01); *F24F 6/02* (2013.01); *F25D 21/14* (2013.01); *F24F 2011/0087* (2013.01); *F24F 2011/0089* (2013.01); *F24F 2013/225* (2013.01); *F25B 31/006* (2013.01); *F25B 47/006* (2013.01); *F25B 47/02* (2013.01); *F25B 2313/0251* (2013.01); *F25B 2400/06* (2013.01); *F25B 2400/071* (2013.01); *F25D 21/06* (2013.01); *F25D 2321/145* (2013.01); *F25D 2321/1411* (2013.01)

(58) Field of Classification Search

CPC .... F25D 21/125; F25B 31/006; F25B 47/006; F25B 2400/071; F25B 47/02; F25B 21/06; F25B 21/12; F25B 2313/0251; F25B 6/02; F24F 2011/0089

See application file for complete search history.

(56) References Cited

U.S. PATENT DOCUMENTS 2,432,316 A * 12/1947 Kemler ..... F25B 29/003 165/240
2,606,803 A * 8/1952 Whelan ..... G07F 11/10 194/240
3,139,924 A * 7/1964 Schreiner ..... F25B 13/00 165/43
3,572,052 A 3/1971 Toth et al.
3,732,703 A 5/1973 Nordstrom et al.

(Continued)

FOREIGN PATENT DOCUMENTS

JP 2000111099 A1 * 4/2000

OTHER PUBLICATIONS

Machine Translation of JP 2000-111099.*

*Primary Examiner* — David Teitelbaum
(74) *Attorney, Agent, or Firm* — Schmeiser, Olsen & Watts, LLP

(57) ABSTRACT

An improved refrigeration cycle defrosting system and method is disclosed. The device uses operation of a compressor to supply heat for the defrosting process without relying on deviation of a hot refrigerant gas from the compressor outlet or any other heating device.

6 Claims, 5 Drawing Sheets

(56) References Cited

U.S. PATENT DOCUMENTS

| | | | | | |
|---|---|---|---|---|---|
| 3,968,660 | A * | 7/1976 | Amann | F25D 17/065 165/108 |
| 4,102,152 | A * | 7/1978 | Covault | F25B 39/04 165/170 |
| 4,365,480 | A | 12/1982 | Darm | |
| 4,484,396 | A | 11/1984 | Darm | |
| 5,187,945 | A | 2/1993 | Dixon | |
| 5,415,011 | A * | 5/1995 | Gilmore | |
| 6,021,644 | A | 2/2000 | Ares et al. | |
| 6,276,158 | B1 * | 8/2001 | Lowes | F25B 13/00 62/151 |
| 7,171,817 | B2 | 2/2007 | Birgen | |
| 7,614,249 | B2 | 11/2009 | Hu | |
| 2004/0028785 | A1 * | 2/2004 | Langourieux | A23F 5/486 426/386 |

* cited by examiner

SYSTEM AND METHOD FOR DEFROSTING A CONDENSOR WITHOUT EXTERNAL HEATING

CROSS-REFERENCE TO RELATED APPLICATIONS

This application claims the benefit and priority to U.S. Provisional Application No. 62/201,909, filed Aug. 6, 2015, and entitled "A System and Method For Defrosting a Condenser Without External Heating."

FIELD OF TECHNOLOGY

The subject matter disclosed herein generally relates to defrosting a condenser in a refrigeration or heating cycle. More particularly, the invention provides a system that utilizes heat generated by the operation of a dual purpose compressor so that an additional heat source is not required and heat is not removed from the cycle. A method of use is also provided.

BACKGROUND

Condensers and evaporators are used in refrigerators, air conditioners, and other equipment which utilizes refrigeration cycles and/or heat pumps. The condensers and evaporators are susceptible to the buildup of frost and ice which may reduce efficiency. A variety of methods exist for defrosting these components; however, many of these require an external heat source or a reversal of the cooling cycle—such that heat is pumped in the opposite direction as normally used for the refrigeration cycle.

Thus, an effective system and method for application of heat already generated as a byproduct of the refrigeration cycle—heat generated by the compressor's regular operation—to a condenser would be well received in the art.

SUMMARY

A first aspect relates generally to a system for defrosting a refrigeration cycle apparatus, comprising: a compressor, the compressor being located within a compressor compartment, wherein the compressor compartment collects heat generated by the compressor; a condenser; a duct connecting the compressor compartment to the condenser; and a means of moving the heat collected in the compressor compartment through the duct and into the condenser.

A second aspect relates generally to a method of defrosting a component of a refrigeration system, comprising: collecting, in a compressor compartment, heat energy generated by a compressor; transferring the heat energy generated by the compressor from the compressor compartment to the component of the refrigeration system; and defrosting, by the transferred heat energy, the component of the refrigeration system.

A third aspect relates generally to a method of evaporating water from a component of a refrigeration system, comprising: providing a drain system attached to the component of the refrigeration system, wherein the drain system includes a collection pan; collecting, in the drain pan, water drained from the component of the refrigeration system; providing, as part of the refrigeration system, a compressor having a compressor fan; providing a compressor compartment at least partially surrounding the compressor; collecting, within the compressor compartment, heat energy produced by operation of the compressor; directing the heat energy collected within the compressor compartment toward the drain pan; and evaporating the water collected in the drain pan using the heat energy from the compressor compartment.

BRIEF DESCRIPTION OF THE DRAWINGS

The subject matter which is regarded as the invention is particularly pointed out and distinctly claimed in the claims included at the conclusion of this specification. The foregoing and other features and advantages of the invention are apparent from the following detailed description taken in conjunction with the accompanying drawings in which:

DETAILED DESCRIPTION

Figure 1:
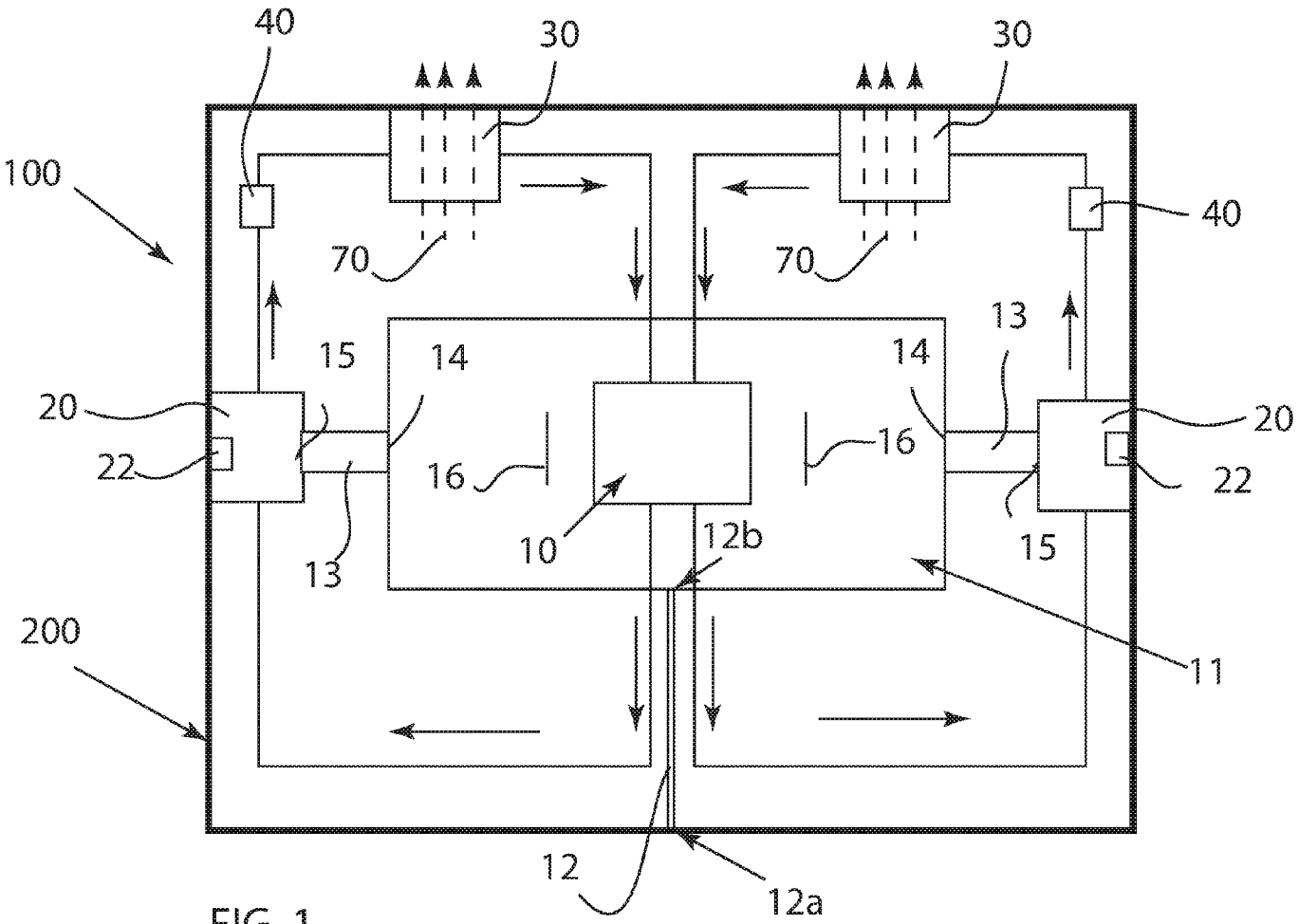
FIG. 1 depicts a schematic view of a refrigeration system configured to perform the disclosed method according to one embodiment.

Although certain embodiments of the present invention will be shown and described in detail, it should be understood that various changes and modifications may be made without departing from the scope of the appended claims. The scope of the present invention will in no way be limited to the number of constituting components, the materials thereof, the devices thereof, the relative arrangement thereof, etc.; these are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Disclosed is an embodiment of a system and method for defrosting a condenser. The system and method may defrost a condenser or evaporator without requiring external heat other than that already generated by a compressor. Further, the system and method may eliminate the need for a set defrost cycle and may eliminate the need for dedicated defrost devices. The system and method may also result in a substantial reduction in energy usage by a refrigerating system; for example, in one embodiment, the system and method may result in a 40% reduction in energy usage.

Referring now to FIG. 1, a refrigerating system 100 is shown. Embodiments of the refrigerating system 100 may comprise a refrigeration cycle, an air conditioning cycle, a heat pump cycle, or other similar system. The refrigerating system 100 may be contained within a housing 200. The system may be controlled by a variety of electrical, electronic, computerized, and thermostatic controls and sensors as is well-understood in the art. The refrigerating system 100 may include a compressor 10 along with one or more condensers 20, and one or more evaporators 30. However, additional components may be present in the refrigeration system 100.

A typical refrigeration system 100 may operate in a well-known process, described broadly as follows: A circulating refrigerant substance is pumped throughout the system 100 and used to transfer heat by various temperature and phase changes. In general, the direction of the circulating refrigerant's flow through the refrigeration system 100 is shown by solid arrows with no corresponding element number. Beginning at the portion of the system 100 pertinent to the compressor 10, the circulating refrigerant substance enters the compressor 10 as a vapor and is compressed. The compressed vapor exits the compressor 10 as a superheated gas. The superheated gas is moved to the condenser 20, where is it cooled, thereby removing the vapor from the superheated state. The condenser 20 then condenses the vapor into a liquid by additional removal of heat. The refrigerant will then pass through an expansion valve 40. As the liquid refrigerant passes through the expansion valve 40, the pressure is rapidly decreased, causing partial evaporation and refrigeration of the circulating refrigerant substance. The refrigerant will then be a mixture of vapor and liquid and will be moved to the evaporator 30. The evaporator 30 blows warm (to be cooled) air (depicted by dashed lines 70) over a coil (not shown) containing the refrigerant substance. The coil may be located within the evaporator 30 or may comprise the evaporator 30. Embodiments of the evaporator 30 and the coil will be well understood by those having skill in the art. The interaction between this air and the coil results in cooler air and full evaporation of the refrigerant.

During the operation of the refrigeration/heat pump system 100, the condensers 20 and/or the evaporators 30 may develop frost and/or ice. Frost and ice may diminish the efficiency of the refrigerating system 100 and may impair its normal functioning. To remedy this decreased efficiency, the condensers 20 and evaporators 30 may be defrosted. While the defrosting step may be necessary for the system 100 to operate, the condenser 20 and the evaporator 30 are not capable of performing their respective roles in the system during the defrosting process. Thus, system 100 may have two or more sets of condensers 20 and evaporators 30 so that the system 100 may continue to operate while one condenser 20 or evaporator 30 is being defrosted.

The compressor 10 may be located within an insulated compressor compartment 11. The compressor compartment 11 may be configured to retain any heat generated by the compressor during its normal function in the refrigerating system 100. The compressor compartment 11 may include an exterior inlet valve 12*a* and an interior inlet valve 12*b* connected by an inlet duct 12. Both the exterior and interior inlet valves 12*a*, 12*b* may be configured to switch between an open position and a closed position. In the open position, the exterior and interior inlet valves 12*a*, 12*b* allows air from outside the compressor compartment 11 to enter the compressor compartment 11. The air from outside the compressor compartment 11 may also be air from outside the housing 200. In one embodiment, the air enters from an outdoor location. In another embodiment, the air enters from an indoor environment.

The compressor compartment 11 may include one or more defrosting ducts 13 which run from the compressor compartment 11 to the one or more condensers 20. The defrosting ducts 13 may have valves located on each end of the duct 13, referred to as a duct intake valve 14 and a duct outlet valve 15, as is shown. Air may move through the ducts 13, generally in the direction from the compressor 10 and compressor compartment 11 toward the condenser 20. Any such airflow may be controlled, regulated, or restricted by the duct intake valve 14 and the duct outlet valve 15. Either or both of the duct intake valve 14 and the duct outlet valve 15 may be capable of forming an airtight seal. Either or both of the duct intake valve 14 and the duct outlet valve 15 may be configured to be insulated so as to retain heat and prevent both heat gain from and loss to any spaces exterior to the defrosting duct 13, including but not limited to the condenser 20 and the compressor 10.

In one embodiment, one or more fans or blowers 16 may be included within the compressor compartment 11. The fans or blowers 16 may be configured to circulate or direct air toward the defrosting duct 13. In a further embodiment, the fan or blower 16 may be included within the compressor 10. For example, the compressor 10 may use a compressor fan (not pictured) or similar device in its normal operation. In one embodiment, the compressor fan included in the compressor 10 may be used to circulate air around or away from the compressor 10 in order to cool the compressor 10 during its operation. In one embodiment, the compressor fan may also act as the fan or blower 16 and be used to conduct air from the compressor compartment 11 for use in defrosting.

Other means of circulating air from the compressor compartment 11 may also be used as known in the art. In a further embodiment, the system 100 may also rely on natural dispersion of air and/or dissipation of heat. For example, in one embodiment, operation of the compressor 10 may heat air within the compressor compartment 11 sufficiently to cause an automatic transfer of heat to condenser 20 when valves 14 and 15 are opened.

Air moving from the compressor compartment 11 to the condenser 20 may provide enough heat to melt any ice and frost which may accumulate in the condenser 20 during operation of the refrigerating system 100. Similarly, in embodiments relying on heat dissipation, the air in the condenser 20 may receive sufficient heat transfer to melt any ice and frost.

Defrosting of the condenser 20 or evaporator 30 may become necessary at various times during operation of the refrigeration system 100. The timing between defrosting may vary depending on the specific features of the system 100, the ambient or environmental temperature, and other conditions that may vary based on the unit or model, the user's preferences or operation habits, or the location of use. In one embodiment, defrosting may occur based on a programmed time of operation. This time frame may be determined manually by a user, or the system may be configured to determine an appropriate time frame based on the temperature, use cycle, or other settings of the refrigerating system 100. For example, the system 100 may be programmed to require defrosting after every thirty minutes of use. Alternatively, the system 100 may include a sensor for determining the temperature of the condenser 20, a sensor for detecting the temperature of the air being circulated, a sensor for detecting the presence of ice, frost, or liquid water, or a sensor capable of estimating the amount of water vapor present in the air. Other types of a sensor may be utilized as well. The sensor, and the parameter detected, may be used by the system to set an appropriate time frame before defrosting is required.

Figure 2:
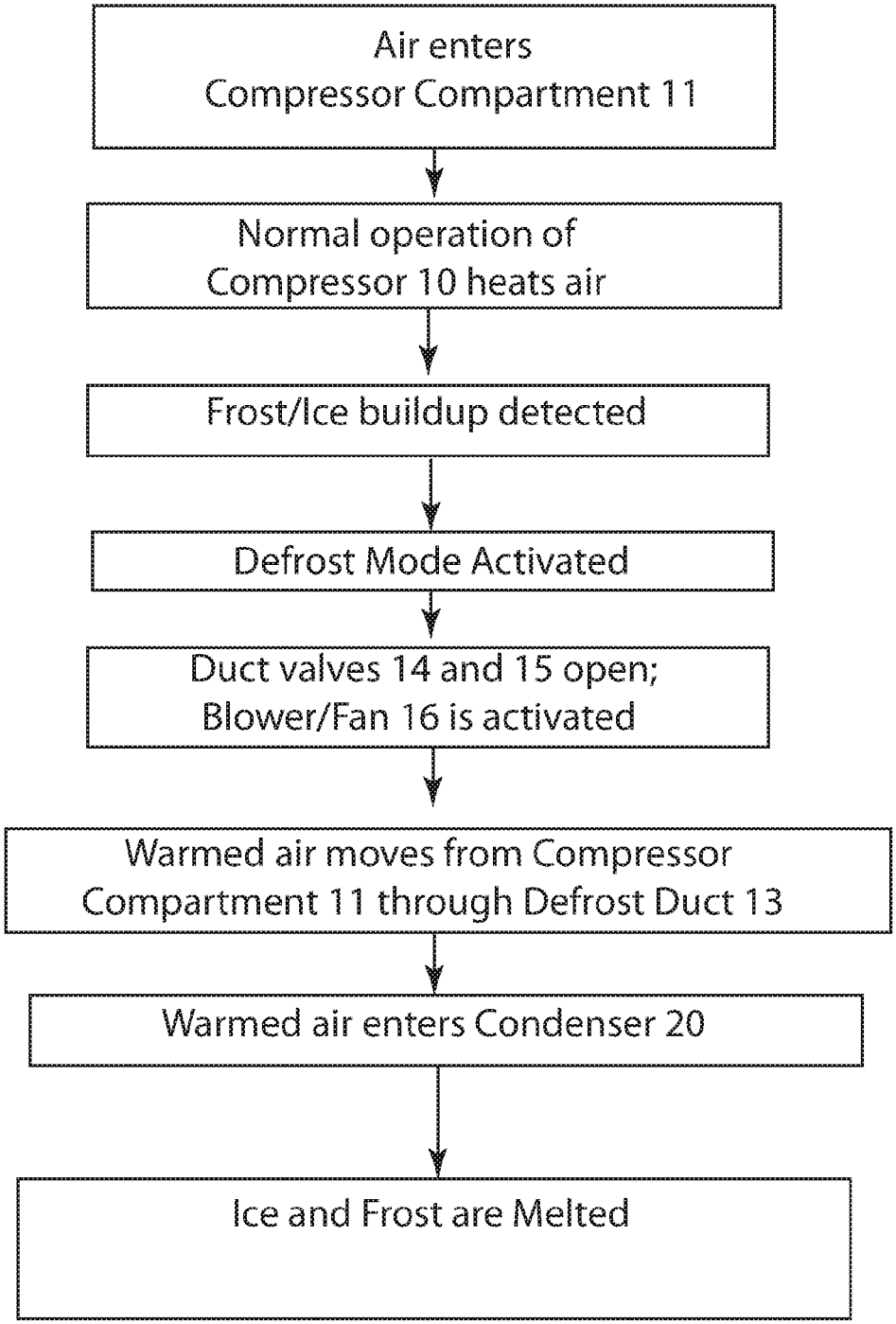
FIG. 2 depicts a flowchart illustrating one embodiment of the disclosed method.

Operation of the system and method according to one embodiment is depicted in the flowchart designated as FIG. 2. Compressor compartment 11 contains air let in from inlet valve 12. When inlet valve 12 is closed, the air in compressor compartment 11 is insulated from outside influence. As compressor 10 operates within the normal course of the refrigeration system 100, compressor compartment 11 and the air located therein may become warm. In an additional embodiment, exhaust from the compressor may be collected in the compressor compartment. Such exhaust may be substantially warmer than an ambient or environmental air temperature, and also warm enough to melt ice or frost. At a point in time during the operation of the refrigeration system 100, one or more of the condensers 20 may develop an accumulation of frost and ice. At this point the refrigeration system 100 may no longer be capable of efficiently operating using that condenser. Instead, that condenser 20 may undergo a defrosting process in order to return it to a state of increased efficiency. When defrosting becomes necessary, the normal refrigeration system 100 ceases with respect to the condenser 20 that requires defrosting. At this point, the warm air contained in the compressor compartment 11 may be used to defrost the condenser 20. Air may be permitted to move through the defrosting duct 13 following opening of duct intake valve 14 and duct outlet valve 15. The fan or blower 16 may be activated to push the warmed air through the defrosting duct 13 and into or in contact with the condenser 20.

In one embodiment the exhaust valve 22 may be opened at substantially the same time as the duct intake valve 14 and the duct outlet valve 15. Warmed air flowing from the compressor compartment 11 may thus flow directly through the condenser 20 and out through the exhaust valve 22.

In an additional embodiment, the exhaust valve 22 may remain closed for at least a portion of the time during which the duct intake valve 14 and the duct outlet valve 15 are open and during which the blower 16 is moving warm air from the compressor compartment 11. The staggered opening of the exhaust valve 22 may allow for maximal heating of the condenser 20 using the warmed air from compressor compartment 11, and may also facilitate quick and efficient evaporation of melted ice and frost. In this embodiment, air and water vapor may only be allowed to continue out of the condenser 20 (through the exhaust valve 22) after melting has been accomplished.

The opening of the exhaust valve 22 may be controlled by a variety of means. For example, in one embodiment described above, the exhaust valve 22 may open simultaneously with the opening of the duct intake valve 14 and the duct outlet valve 15, or simultaneously with the activation of the blower 16. In an additional embodiment, the exhaust valve 22 may open only after a specified time has elapsed in order to give adequate time for melting of ice and frost and/or evaporation of liquid water. This time frame may be determined manually by a user, or the system may be configured to determine an appropriate time frame based on the temperature, use cycle, or other settings of the refrigerating/heat pump system 100. Alternatively, the system may include a sensor for determining the temperature of the condenser 20, a sensor for detecting the temperature of the air being circulated, a sensor for detecting the presence of ice, frost, or liquid water, or a sensor capable of estimating the amount of water vapor present in the air. Other types of a sensor may be utilized as well. The sensor, and the parameter detected, may be used by the system to set an appropriate time frame before opening the exhaust valve 22 or may be used by the system to ensure that all melting and/or evaporation has occurred before opening of the exhaust valve 22.

In one embodiment, the air in the compressor compartment 11 may be under pressure. For example, inlet valve 12 may be equipped to force air into the compressor compartment 11, whether by suction or other means. Provided that the duct intake valve 14 is closed, the air forced into compressor compartment 11 may be placed under a pressure greater than ambient pressure. Increased pressure of the compressor compartment 11 may complement the heat generated by the compressor 10 to provide substantially warmed air. When the duct intake valve 14 is opened to permit passage of the warmed air into the condenser 20 for defrosting, the warmed air may naturally flow to the lower pressure area of the condenser 20, facilitating rapid defrosting. The blower/fan 16 may or may not be necessary depending on the respective pressure difference.

In a further embodiment, one or both of the duct intake valve 14 and duct outlet valve 15 may be capable of moving air from the compressor compartment 11 to the condenser 20 at a greater than ambient pressure. Warmed air may thus be removed from the compressor compartment 11 and forced into the condenser 20 in order to rapidly defrost the condenser 20. Following defrosting with warmed and pressurized air, the condenser exhaust valve 22 may be opened to release the increased pressure.

In one embodiment, increased pressure may also be used to prevent evaporation of melted ice and frost. Instead of evaporating upon melting, more water may remain in a liquid state and collect in the drain pan, from which it may easily flow out into the waste line or be removed manually. Limiting evaporation in this way may be useful in refrigerating/heat pump systems 100 which are sensitive to the humidity of the ambient air, or in embodiments in which it is difficult to completely vent the air in the condenser 20 to remove air containing high concentrations of water vapor.

Melting ice and frost may also result in the formation and accumulation of water vapor in the condenser 20. Water vapor may be formed by the evaporation of water (from the melted ice and frost) by the heat from the compressor 11. While some water vapor may be allowed to remain in the condenser, large quantities of water vapor may decrease the efficiency of the refrigerating system 100. In one embodiment, the water vapor content in the condenser may be lowered by simply blowing the warm air from the compressor compartment 11 through the defrosting duct 13 and the condenser 20. The air blown from the compressor compartment 11 may pass through the condenser 20, exiting through an exhaust valve 22. The exhaust valve 22 may be configured to switch between an open and a closed position. When in the open position, the exhaust valve 22 allows for the passage of air out of the condenser 20. When in the closed position, the exhaust valve 22 may be configured to form an airtight seal, and may thermally insulate the condenser 20 from any outside location.

Figure 4:
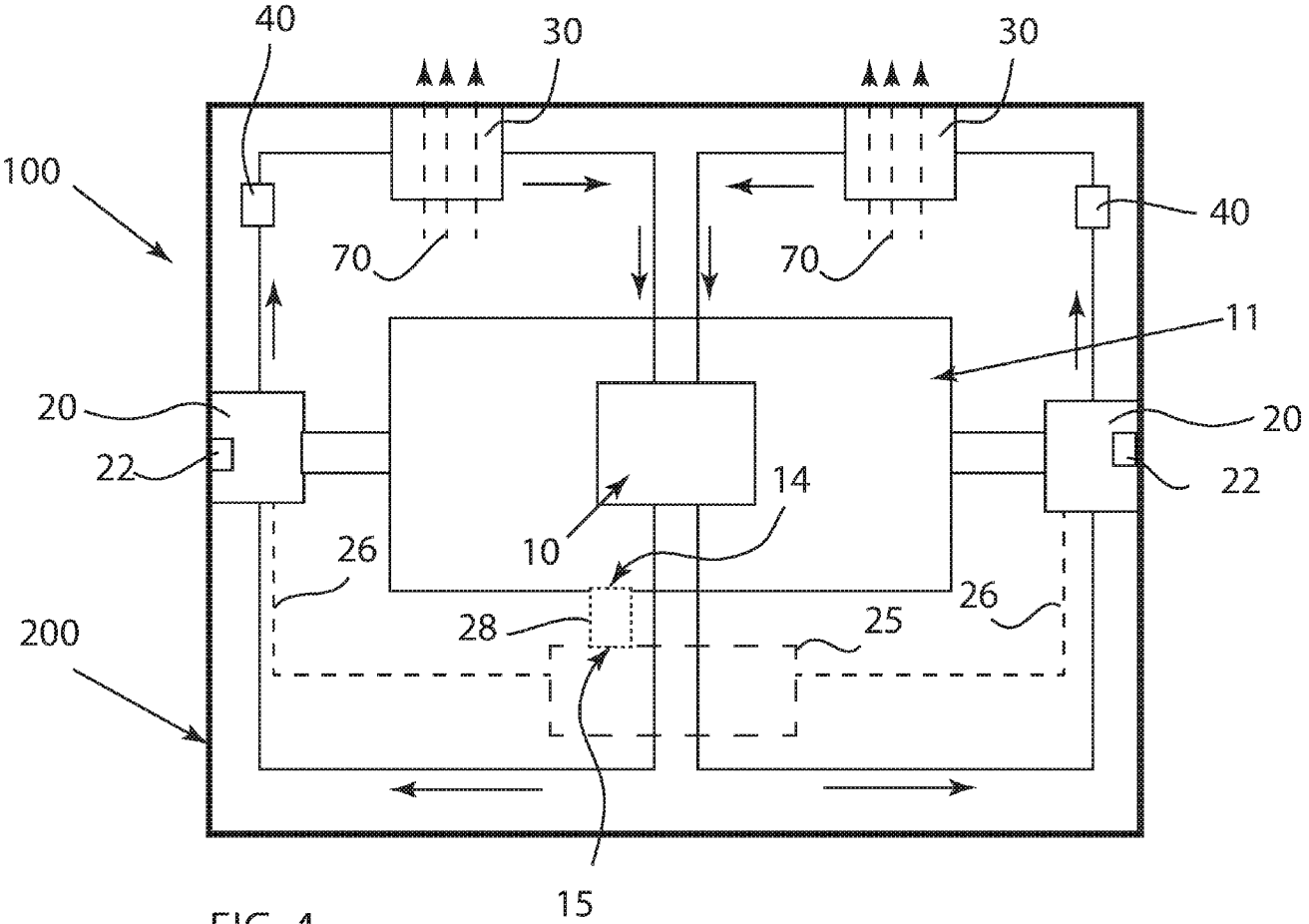
FIG. 4 depicts a schematic view of a refrigeration system configured to perform the disclosed method and comprising a drainage system.

In a further embodiment, the liquid water may be collected in a drain pan 25 (shown in FIGS. 4 and 5) included in a lower portion of the condenser 20 or connected to the condenser 20 by a drainage line 26. The drain pan 25 may empty directly into a waste line or other suitable location, or may require manual removal and emptying. In FIG. 4, the drain pan and drainage lines 26 are shown as located under certain other components of the refrigeration system 100 (some of which have been removed from this figure—removal is only for convenience in demonstrating the pertinent components, and is not meant to limit the design of any embodiment). Further the placement of the drain pan 25 in FIG. 4 is merely representative of possible locations; the drain pan 25 may be placed in any suitable location in relation to the other elements of the system 100.

In a still further embodiment, the drain pan 25 may not require emptying or connection to a waste line. Instead, the warm air flowing to the exhaust valve 22 may be directed over the collected water in the drain pan 25 and may evaporate the collected water. The water vapor created by the evaporation may be removed from the condenser 20 as the air flows out of the condenser 20 through exhaust valve 22. Thus, warm air from the compressor compartment 11 may be used to both defrost the condenser 20 and to evaporate or remove the resulting water from the drain pan 25 in back-to-back, nearly-simultaneous, or simultaneous steps.

Figure 5:
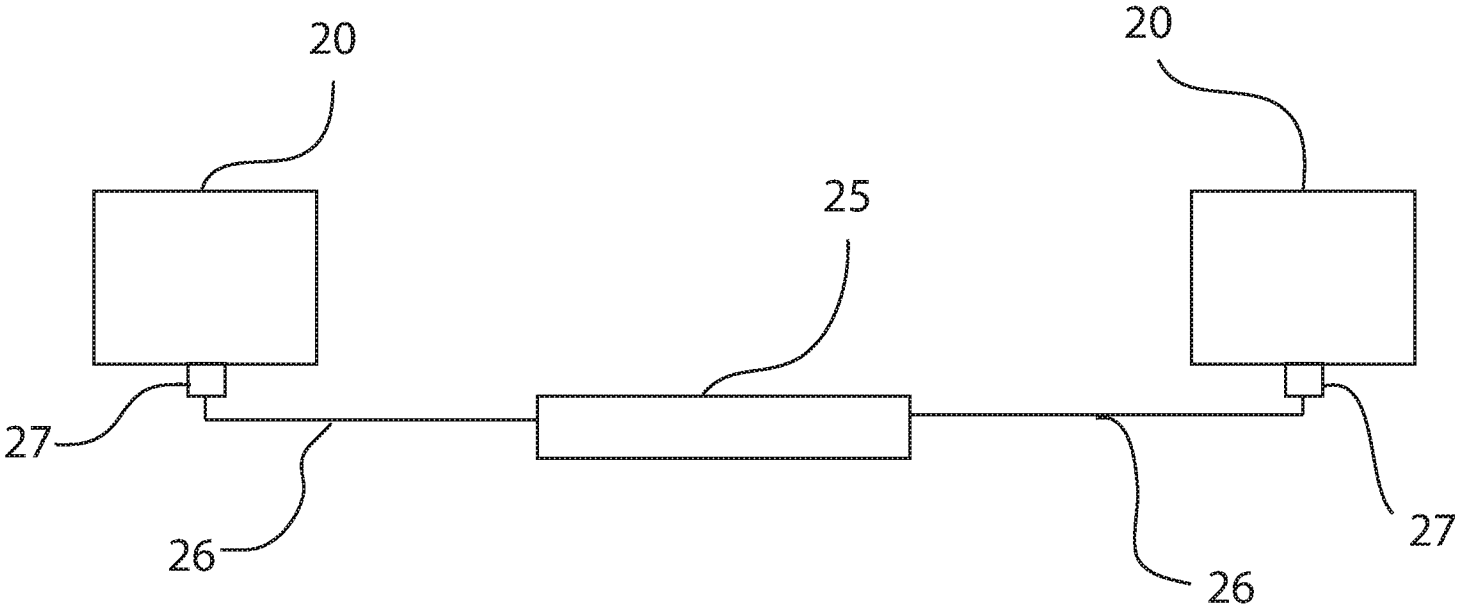
FIG. 5 depicts a schematic view of a drainage system of a refrigeration system configured to perform the disclosed method.

In a still further embodiment, as shown in FIGS. 4 and 5, the drain pan 25 may be simply connected to the condenser 20 by a drainage line 26 as described above and shown in FIG. 4. Again, the placement of elements in the figures is meant to be representative only, and is not meant to limit the placement of the elements. In one embodiment, the drainage line 26 may include a drainage line valve 27, which may form an opening between the condenser 20 and the drainage line 26. For example, when the drainage line valve 27 is open, water (and air) may be able to flow from the condenser 20 into the drainage line 26. When the drainage line valve 27 is closed, water and air may be restricted from flowing out of the condenser 20 at this location. The drainage line valve 27 may be substantially air and water tight, and may be insulated limit the transfer of heat to or from the refrigeration system 100.

After defrosting, water may leave the condenser 20 through the drainage line valve 27 and the drainage line 26, and may be collected in the drain pan 25. Warm air may also leave the condenser 20 through the drainage line 26 and evaporate the water collected in the drain pan 25. The drainage line valve 27 may be closed after defrosting is complete or after defrosting and evaporating is complete. After defrosting is complete, defrosting is no longer required. Therefore, warmed air in the compressor compartment 11 may not be needed for defrosting, but may still be used for evaporating any remaining water. Warmed air may be passed over the drain pan 25 in order to evaporate the water contained therein. Air may be directed from the compressor compartment 10 to pass over the drain pan 25 by passing through a duct 28 or by another means as known in the art. Duct 28 may be similar to duct 13. Duct 28 may also contain a duct intake valve 14 and a duct outlet valve 15. The duct intake and outlet valves 14 and 15 may function as has been described above in order to regulate the flow of air from the compressor compartment 10 to the drain pan 25.

The air containing the evaporated water (from drain pan 25) may be directed away from the refrigeration system 100 and any housing 200. For example, in one embodiment the air containing the evaporated water may be directed to a specific location through a vent. Such an embodiment may be used if the evaporated water or more humid air is wished to be directed to an area to be humidified, or if it is wished to be directed to an outdoor location. In a further embodiment, the air containing the evaporated water may be directed away from the refrigeration system 100 and allowed to dissipate with no specific direction (whether inside or outside).

The embodiment in which warmed air is directed over the drain pan 25 may be used in conjunction with other embodiments, or may be used separately as a way to evaporate water resulting from a defrosting cycle. Further, it is intended that features disclosed with respect to moving air into and out of the condenser 20 and/or the evaporator 30 may be applied to the feature of moving air into and out of the drain pan 25 in one or more embodiments.

Figure 3:
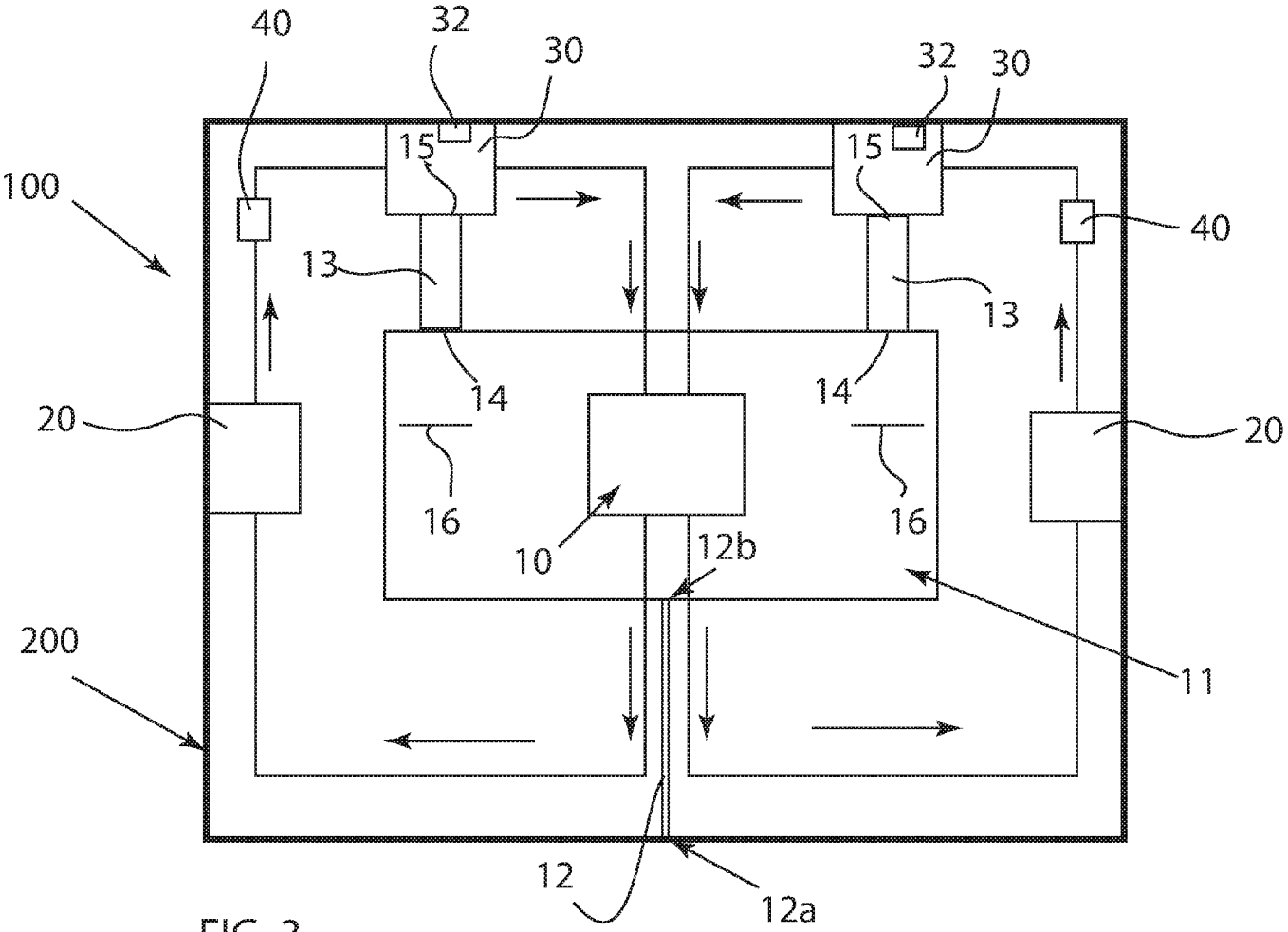
FIG. 3 depicts a schematic view of a refrigeration system configured to perform the disclosed method according to a further embodiment.

Each of the above embodiments may be applied to the evaporator 30 in much the same way as the condenser 20. A refrigeration cycle configured to defrost multiple evaporators 30 is depicted in FIG. 3. For example, in one embodiment the compressor compartment 11 may include one or more defrosting ducts 13 which run from the compressor compartment 11 to the one or more evaporators 30. The defrosting ducts 13 may have valves located on each end of the duct 13, a duct intake valve 14 and a duct outlet valve 15, as has been described above. Air may move through the ducts 13, generally in the direction from the compressor 10 and compressor compartment 11 toward the evaporator 30. Any such airflow may be controlled, regulated, or restricted by the duct intake valve 14 and the duct outlet valve 15. Either or both of the duct intake valve 14 and the duct outlet valve 15 may be capable of forming an airtight seal. Either or both of the duct intake valve 14 and the duct outlet valve 15 may be configured to be insulated so as to retain heat and prevent both heat gain from and loss to any spaces exterior to the defrosting duct 13, including but not limited to the evaporator 30 and the compressor 10.

In one embodiment, one or more fans or blowers 16 may be included within the compressor compartment 11. The fans or blowers 16 may be configured to circulate or direct air toward the defrosting duct 13 and thus toward the evaporator 30. In a further embodiment, the fan or blower 16 may be included within the compressor 10. For example, the compressor 10 may use a compressor fan (not pictured) or similar device in its normal operation. In one embodiment, the compressor fan included in the compressor 10 may be used to circulate air around the compressor 10 in order to cool the compressor 10. In one embodiment, the compressor fan may act as the fan or blower 16 and be used to conduct air from the compressor compartment 11 for use in defrosting. Other means of circulating air form the compressor compartment 11 may also be used as known in the art. In a further embodiment, the system may also rely on natural dispersion of air and/or dissipation of heat. For example, in one embodiment, operation of the compressor 10 may heat air within the compressor compartment 11 sufficiently to cause an automatic transfer of heat to evaporator 30 when valves 14 and 15 are opened.

Air moving from the compressor compartment 11 to the evaporator 30 may provide enough heat to melt any ice and frost which accumulated in the evaporator 30 during operation of the refrigerating system or the heat pump system 100. Similarly, in embodiments relying on heat dissipation, the air in the evaporator 30 may receive sufficient heat transfer to melt any ice and frost.

Melting ice and frost may also result in the formation and accumulation of water vapor in the evaporator 30. Water vapor may be formed by the evaporation of water (from the melted ice and frost) by the heat from the compressor 11. While some water vapor may be allowed to remain in the evaporator 30, large quantities of water vapor may decrease the efficiency of the refrigerating system 100. In one embodiment, the water vapor content in the condenser may be lowered by simply blowing the warm air from the compressor compartment 11 through the defrosting duct 13 and the evaporator 30. The air blown from the compressor compartment 11 may pass through the evaporator 30, exiting through an exhaust valve 32. The exhaust valve 32 may be substantially similar to the exhaust valve 22 and may include the same features and capabilities. The exhaust valve 32 may be configured to switch between an open and a closed position. When in the open position, the exhaust valve 32 may allow for the passage of air out of the evaporator 30.

When in the closed position, the exhaust valve 32 may be configured to form an airtight seal, and may thermally insulate the evaporator 30 from any outside location. The evaporator may also include a drain pan 25 as has been described above in reference to the condenser 20. Various methods of evaporating water from the drain pan have been previously described and are applicable to water collected from the evaporator 30 as well.

Like the embodiment described with reference to the condenser 20, the defrosting process for the evaporator 30 may utilize air under pressure, whether in the compressor compartment 11, the duct 13, or the evaporator 30.

In a further embodiment, the refrigerating system 100 may be configured to include defrosting capabilities for both the condensers 20 and the evaporators 30. Thus, in one embodiment a complete set of the duct 13, the intake and outlet valves 14, 15, and the blower/fan 16 may be provided to move air to both the condenser 20 and the evaporator 30. In this embodiment, both the condenser 20 and evaporator 30 may be defrosted at the same time. Alternatively, the condenser 20 and evaporator 30 may be defrosted sequentially during the same defrosting period, or may be defrosted on an alternating basis—i.e., the condenser 20 is defrosted in one defrosting cycle, and the evaporator 30 is defrosted in the next defrosting cycle. In a further embodiment, one blower/fan 16 may be used for both the condenser 20 and the evaporator 30. The blower/fan may be powerful enough to provide warmed air to both or either of the condenser 20 and the evaporator 30, or may be capable of rotating to direct warmed air primarily to one or the other.

As has been described, the refrigeration system 100 may comprise two or more sets of condensers 20 and evaporators 30 such that one set (or one component of a set, i.e., a condenser or an evaporator individually) may be defrosted while the other set (or component) remains operational for the purpose of the refrigeration system 100. Similarly, two or more fans or blowers 16 may be used in one embodiment. In a further embodiment, only one fan or blower 16 may be used. Still further, the one fan or blower 16 may be a fan or blower included within the compressor compartment 11 for the normal operation of the compressor 10, such as a fan to direct heat away from the compressor 10 during operation. The single fan or blower 16 may be capable of forcing air to a component of either set of condensers 20 or evaporators 30.

In one embodiment, the refrigeration system 100 may include two or more drain pans 25, one for each set of condenser 20 and evaporator 30, or one for each condenser 20 and each evaporator 30 individually. However; in a further embodiment, only one drain pan 25 may be used. In this embodiment, each component to be defrosted, such as a condenser 20 and/or an evaporator 30, may have its own drainage line 26 and drainage line valve 27; however, in a further embodiment each drainage line 26 may empty into one single drain pan 25. In this embodiment, air may be directed from the compressor compartment 11 to the single drain pan 25 for evaporation of the liquid water which results from the defrosting, whether immediately following or simultaneous with the defrosting step as has been described or as part of a separate evaporation step as has also been described.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A system for defrosting a refrigeration cycle apparatus, the system comprising:

a compressor, the compressor being located within a compressor compartment, and the compressor compartment being defined by a single chamber, wherein the compressor compartment collects heat generated by the compressor so that warm air builds up within the single chamber;

a condenser;

a duct directly connecting the compressor compartment to the condenser; and a means of moving the warm air collected in the compressor compartment through the duct and through an exhaust valve of the duct into the condenser, when the condenser needs to be defrosted, wherein the exhaust valve of the duct has a staggered opening to allow for evaporation of ice and frost on the condenser; and wherein the warm air flows within the single chamber until being moved through the duct directly from the single chamber into the condenser.

2. The system of claim 1, further comprising:

two or more condensers; and two or more ducts, wherein each duct of the two or more ducts directly connects the compressor compartment to a corresponding condenser of the two or more condensers.

3. The system of claim 1, wherein the compressor includes a compressor fan used during operation of the compressor; and wherein the means of moving the heat collected in the compressor compartment to the condenser includes: natural dispersion of the warm air or includes use of the compressor fan.

4. The system of claim 1, further comprising:

a collection pan used to collect water generated during defrosting of the condenser.

5. The system of claim 4, further comprising:

a means of moving the heat collected in the compressor compartment over the water collected in the collection pan to evaporate the collected water.

6. The system of claim 1, wherein the condenser is defrosted by the heat generated by the compressor without external heating other than the heat generated by the compressor.

* * * * *